United States Patent [19]

Nicholai

[11] 4,125,910

[45] Nov. 21, 1978

[54] LAZY MAN'S SLEEPING BAG

[76] Inventor: Wassillie P. Nicholai, P.O. Box #1, Togiak, Ak. 99678

[21] Appl. No.: 797,482

[22] Filed: May 16, 1977

[51] Int. Cl.[2] ..... A47G 9/00

[52] U.S. Cl. ..... 5/343; 5/334 R; 2/69.5

[58] Field of Search ..... 5/343, 334; 2/69.5, 2/69

[56] References Cited

U.S. PATENT DOCUMENTS

| | | | |
|---|---|---|---|
| 1,079,798 | 11/1913 | Painter | 5/343 |
| 1,915,044 | 6/1933 | Anderson | 5/343 |
| 2,378,434 | 6/1945 | Robinson | 5/343 |
| 2,505,492 | 4/1950 | Heider | 5/343 |
| 3,042,939 | 7/1962 | Schoellkopf et al. | 5/343 |
| 3,924,273 | 12/1975 | Donovan | 5/343 |

*Primary Examiner*—Victor N. Sakran
*Attorney, Agent, or Firm*—Howard I. Podell

[57] ABSTRACT

A sleeping bag for camping use which serves alternately as a temporary garment on a cold morning after awaking, and until the user has started a fire. The bag is formed with a pair of foldable sleeve sections each joined to the body of the bag below the normal elbow position of the wearer and a pair of foldable leg sections, each joining to the body of the bag below the normal knee position of the wearer, with pockets externally fastened to the bag for retention of the arm and leg sections when the sleeper is encased in the bag. An elastic loop is fixed to each of the two lower corners of the bag. The bag is fitted with a conventional front slide type fastener extending vertically from the crotch to the neck section and formed with a helmet section for enclosing the head of the wearer.

1 Claim, 6 Drawing Figures

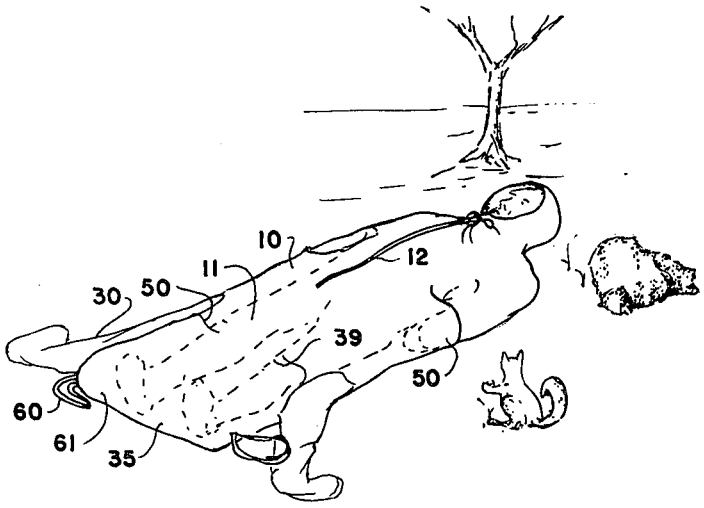
FIG. 1
FIG. 2
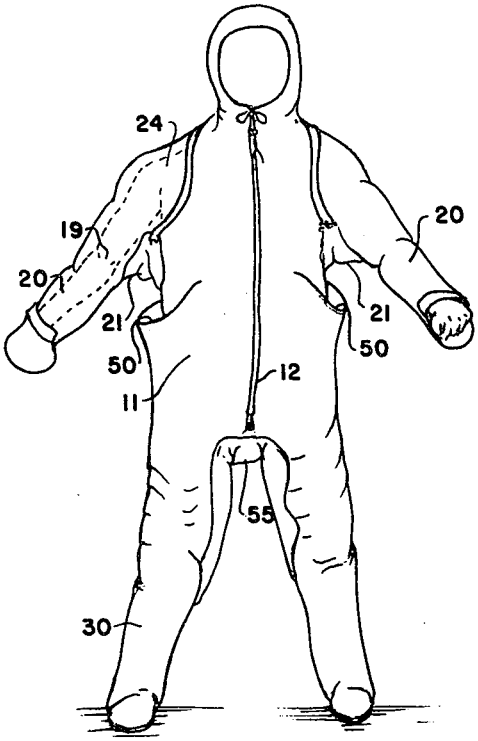
FIG. 3
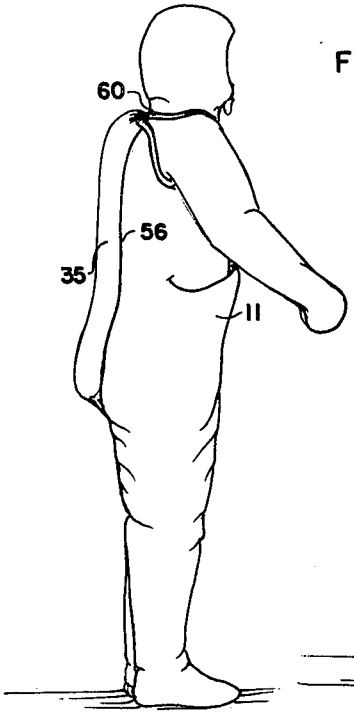
FIG. 4
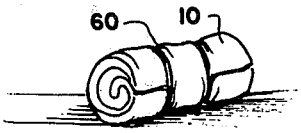
FIG. 5
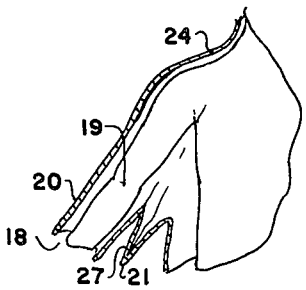
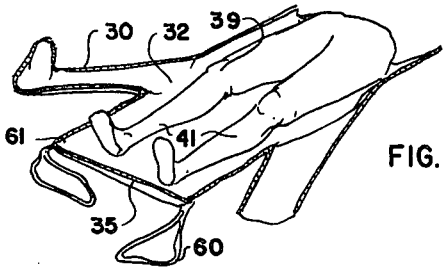
FIG. 6

LAZY MAN'S SLEEPING BAG

SUMMARY OF THE INVENTION

My invention is a sleeping bag for camping use which serves alternately as a temporary garment on a cold morning after awaking, and until the user has started a fire. The bag is formed with a pair of foldable sleeve sections each joined to the body of the bag below the normal elbow position of the wearer and a pair of foldable leg sections, each joining to the body of the bag below the normal knee position of the wearer, with pockets externally fastened to the bag for retention of the arm and leg sections when the sleeper is encased in the bag. An elastic loop is fixed to each of the two lower corners of the bag. The bag is fitted with a conventional front slide type fastener extending vertically from the crotch to the neck section and formed with a helmet section for enclosing the head of the wearer.

In use, the wearer sleeps in the bag, with the arm and leg sections folded in the pockets. Upon awakening, he may easily extend each arm into a sleeve section, and each leg into a leg section. The lower empty section of the bag is then folded backwards between the crotch of the leg sections to extend upwards with each arm of the wearer fitted through an elastic loop. The elastic loops not only hold the lower empty section of the bag against the back of the wearer, but also serve to tighten the folds of the crotch of the arm sections and the leg sections so that the wearer may now walk and swing his legs in customary fashion. The loops also serve to fasten about the bag, when rolled up for storage or transport.

BRIEF DESCRIPTION OF THE DRAWINGS

The objects and features of the invention may be understood with reference to the following detailed description of an illustrative embodiment of the invention, taken together with the accompanying drawings in which:

FIG. 1 is a perspective view of the invention in use as a sleeping bag;

FIG. 2 is an elevation view of the invention in use as a garment;

FIG. 3 is a side view of the invention, worn as a garment;

FIG. 4 is a perspective view of the bag rolled up for storage or transport;

FIG. 5 is a detail sectional view of an arm sleeve section; and

FIG. 6 is a detail sectional view of a leg sleeve section.

DESCRIPTION OF THE PREFERRED EMBODIMENT

Turning now descriptively to the drawings, in which similar reference characters denote similar elements throughout the several views, FIG. 1 illustrates the garment 10 employed as a sleeping bag. The device is formed of insulated flexible material and shaped as a sleeping bag with a torso section 11, the upper half of which is fitted with a slide fastener 12. A helmet section 15 with a face opening is joined to the torso section in conventional manner. Garment 10 is of a size to enclose the body of the user, when reclining with both legs and both arms encased in the common torso section 11.

A pair of arm sleeves 20 extend on opposed sides of the upper shoulder section 24 of the torso section, with the crotch section 21 of each arm sleeve 20 extending below the normal position of the elbow joint 19 of the encased user and the opening 18 between the sleeve and torso section, so that the wearer, may readily move his arm from the torso section into an arm sleeve section. Excess material is folded on the under section 27 of the crotch section so that a user may freely swing his arm after he places it in an arm sleeve section.

A pair of leg sleeves 30 extend on opposed sides of the lower common torso section 35, with the opening 32 of the crotch section 31 of each leg sleeve extending below the normal position of the knee joint 39 so that a user with both legs 41 initially in the common lower torso section 35 may individually shift each of his legs into an individual leg sleeve section 30, without opening the garment.

Each leg and arm sleeve may be enclosed at its free end, and each sleeve may be folded, when the unit is initially employed as sleeping bag to fit into an external pocket 50.

Once the user has moved his arms and legs out of the torso section and into individual sleeve section, the lower torso section 35 is folded under the leg crotch 55 and upon the back 56 of the wearer with the user placing each arm sleeve through an elastic loop 60 that is fixed to a corner section 61 of the lower torso section. The loops serve to tighten the excess arm crotch material 27 as shown by dash lines in FIG. 2 as well as to lift the forward section of the leg crotch section 55 so that the user's legs extend the full length of the leg sleeves.

After the user has started a fire and warmed himself, he may then change out of the garment 10 which is rolled up and held as a roll by the elastic loops 60, as shown in FIG. 4.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A sleeping bag fitted with foldable arm and leg sleeves that extend from an individual opening in a side of the bag to enable the sleeping bag to serve alternatively as a garment in which the wearer may walk about, said bag formed of flexible material and shaped as a sleeping bag with a torso section of a size to enclose the complete body of a person with both legs and arms of the person enclosed in the said torso section, with a pair of arm sleeves, each suitable for receiving an arm of the enclosed person each extending from an individual opening in an opposed side of an upper portion of the torso section, and a pair of leg sleeves, each suitable for receiving a leg of the enclosed person, each extending from an individual opening in an opposed side of an intermediate portion of the torso section, with a lower section of the torso section extending below the openings in the torso to which the leg sleeves are joined, and between said sleeves, such that said lower section may be folded, when the person has fitted each of his legs into a leg sleeve, between the leg sleeves and upwards about the back of the user, in which an elastic loop in the shape of a closed ring is fixed to each of the two lower corners of the bag so as to tie the lower section of the torso section about the back of the wearer when each loop is mounted about an arm sleeve at the shoulder of the user after the wearer has shifted each of his legs into an individual leg sleeve, each said loop when so fastened, also serving to compact excess material of the crotch section of an arm sleeve about which it is so mounted, together with a pair of pockets formed in the torso section of the bag that are each open from the exterior of the bag, with each pocket of a size and located so as to be able to receive and enclose a folded end of a leg sleeve and of an arm sleeve in the sleeping bag mode of the device.

* * * * *